US005448866A

United States Patent [19]

Saito et al.

[11] Patent Number: 5,448,866

[45] Date of Patent: Sep. 12, 1995

[54] TRUSSES AND PRECAST CONCRETE SLABS REINFORCED THEREBY

[75] Inventors: Makoto Saito, Kawasaki; Toshiyuki Yoshimatsu, Musashimurayama; Kansuke Homma, Tama; Itaru Saito, Gunma; Riyouichi Nakajima, Tokyo, all of Japan

[73] Assignees: Kajima Corporation; Hory Corporation Co., Ltd., both of Tokyo, Japan

[21] Appl. No.: 214,162

[22] Filed: Mar. 17, 1994

Related U.S. Application Data

[63] Continuation of Ser. No. 599, Jan. 4, 1993, which is a continuation of Ser. No. 820,015, Jan. 13, 1992, which is a continuation of Ser. No. 574,866, Aug. 30, 1990, abandoned.

[30] Foreign Application Priority Data

| | | | |
|---|---|---|---|
| Sep. 7, 1989 | [JP] | Japan | 105206 |
| Nov. 9, 1989 | [JP] | Japan | 130806 |
| Nov. 9, 1989 | [JP] | Japan | 291793 |

[51] Int. Cl.[6] ..... F04C 3/09; F04C 5/06

[52] U.S. Cl. ..... 52/414; 52/332; 52/600; 52/649.1; 52/692; 52/694

[58] Field of Search ..... 52/334, 335, 336, 693, 52/694, 695, 730.1, 730.2, 731.1, 692, 690, 600, 602, 729, 332, 414, 319

[56] References Cited

U.S. PATENT DOCUMENTS

| | | | |
|---|---|---|---|
| 1,906,683 | 5/1933 | Weiskopf et al. | 52/729 |
| 2,421,197 | 5/1947 | Green | 52/694 |
| 3,328,931 | 7/1967 | Smith | 52/729 |
| 3,407,547 | 10/1968 | Doke et al. | 52/729 |
| 4,054,013 | 10/1977 | Pitto et al. | 52/694 |
| 5,235,791 | 8/1993 | Yaguchi | 52/414 |

FOREIGN PATENT DOCUMENTS

| | | | |
|---|---|---|---|
| 212962 | 1/1958 | Australia | 52/694 |
| 245771 | 3/1966 | Austria | 52/694 |
| 1211781 | 3/1966 | Germany | 52/694 |
| 1269324 | 5/1968 | Germany | 52/694 |
| 2439713 | 3/1976 | Germany | 52/693 |
| 3418313 | 11/1985 | Germany | 52/334 |
| 256421 | 3/1949 | Switzerland | 52/730 |
| 1196880 | 7/1970 | United Kingdom | 52/602 |
| 8001817 | 9/1980 | WIPO | 52/602 |

*Primary Examiner*—Michael Safavi

*Attorney, Agent, or Firm*—Armstrong, Westerman, Hattori, McLeland & Naughton

[57] ABSTRACT

A space truss is constructed of a pair of plane trusses. Each of the plane trusses is constructed of an upper and lower chord member fixedly connected with each other through a strut member interposed therebetween. The thus constructed plane trusses are oppositely disposed from each other in a condition in which the strut member of each of the plane trusses are interposed between the thus oppositely disposed plane trusses, the upper chord members of the plane trusses are closely disposed together, and the lower chord members of the plane trusses are spaced apart from each other. A sheet steel is fixedly connected to the space truss through a hanging hook to form a composite-type space truss. Any of these space trusses are embedded in concrete in the factory to form a precast reinforced concrerte slab.

2 Claims, 4 Drawing Sheets

TRUSSES AND PRECAST CONCRETE SLABS REINFORCED THEREBY

This application is a continuation of application Ser. No. 08/000,599, filed Jan. 4, 1993, which was a continuation of application Ser. No. 07/820,015, filed Jan. 13, 1992, which application was a continuation application of Ser. No. 07,574,866, filed Aug. 30, 1990, now abandoned.

BACKGROUND OF THE INVENTION

1. Field of the Invention:

The present invention relates to a space truss, a precast reinforced concrete slab reinforced by the space truss; a modified space truss or reinforcing member for reinforcing the concrete slab, the reinforcing member being composed of the space truss, a hanging hook suspended from the space truss and a sheet-steel formwork suspended from the hanging hook; and a modified precast reinforced concrete slab in which are embedded the space truss, hanging hook and the sheet-steel formwork. The space truss is constructed of a pair of plane trusses which is oppositely disposed from each other and fixedly connected with each other so as to be formed into the space truss. The space truss is embedded in concrete to form the precast reinforced concrete slab.

2. Prior Art

Hithereto, in order to reinforcing a precast concrete slab serving as a concrete floor and a concrete wall, conventional trusses are embedded in the precast concrete slab. A first one of the conventional trusses is composed of an upper and a lower chord member assembled in three dimensions; and strut members welded to the thus assembled three-dimensional chord members to form a space truss. A second one of the conventional trusses is composed of chord members lying in a single plane; and strut members welded to such chord members in the single plane to form a plane truss which is then symmetrically bent along its one of the chord members to form a space truss in which the one of the chord members serves as an upper chord member of the space truss. However, as for the first one of the trusses, it is necessary to weld the strut members to the chord members after the chord members are assembled in three dimensions. On the other hand, as for the second one of the trusses, it is necessary to bent the plane truss after the strut members are welded to the chord members. As described above, any of the first and the second one of the trusses requires a difficult working in manufacturing thereof, and, therefore has a fear that the thus completed space truss is poor in dimensional accuracy. Particularly, any of the conventional trusses substantially provides a single reinforcing steel bar extending from an upper surface of the precast reinforced concrete slab when embedded in the concrete slab. Consequently, the precast concrete slab reinforced by the conventional space truss lacks structural strength, and, therefore makes it impossible that construction workers effectively perform their works on the precast reinforced concrete slab. In order to resolve these problems, in the conventional precast concrete slab, the space trusses are closely embedded in the concrete slab so as to extend in a width direction of the slab, or intersect with each other at right angles in the slab. However, such embedding work of the conventional space trusses is very cumbersome. Particularly, in the construction field, such embedding work is very poor in workability.

SUMMARY OF THE INVENTION

It is an object of the present invention to provide a novel space truss which resolves the above problems inherent in the conventional space trusses, is precisely assembled in an easy manner, and is excellent in structural strength and workability. The space truss of the present invention is embedded in a precast concrete slab to form a novel and useful precast reinforced concrete slab of the present invention.

It is another object of the present invention to provide such a novel and useful precast reinforced concrete slab reinforced by the space truss of the present invention.

The above objects of the present invention are accomplished in accordance with a first aspect of the present invention by providing:

A space truss comprising a pair of plane trusses oppositely disposed from each other, each of which plane trusses is constructed of a pair of an upper and a lower chord member both of which are welded to a strut member, the upper chord members being welded to each other through a pair of the strut members which are interposed between the upper chord members of the plane trusses and welded to each other to intergrally from the space truss, and has the upper chord member thereof abutted on the other or the upper chord member of the other of the plane trusses, and has the lower chord member thereof spaced apart from the other or the lower chord member of the other of the plane trusses.

Further, the above objects of the present invention are accomplished in accordance with a second aspect of the present invention by providing:

The space truss as set force in the first aspect of the present invention, wherein a sheet steel, which forms a formwork for depositing of concrete, is disposed under the lower chord members of the space truss, a hanging hook which is interposed between the lower chord members and the sheet steel, while provided with at least one hook portion through which the hanging hook engages with the lower chord members of the space truss so as to permit the lower chord members of the space truss to vertically move to the extent of a predetermined distance relative to the hanging hook, the hanging hook being welded to the sheet steel.

Further, the above objects of the present invention are accomplished in accordance with a third aspect of the present invention by providing:

A precast reinforced concrete slab comprising the space truss as set forth in any one of the above aspects of the present invention, wherein the lower chord members of the space truss are embedded in a concrete slab in a condition in which the upper chord members of the space truss extend from an upper surface of the concrete slab, so as to form a precast reinforced concrete slab reinforced by the space truss.

DETAILED DESCRIPTION AND THE PREFERRED EMBODIMENTS

Hereinbelow, preferred embodiments of the present invention will be described in detail with reference to the accompanying drawings.

Figure 1:
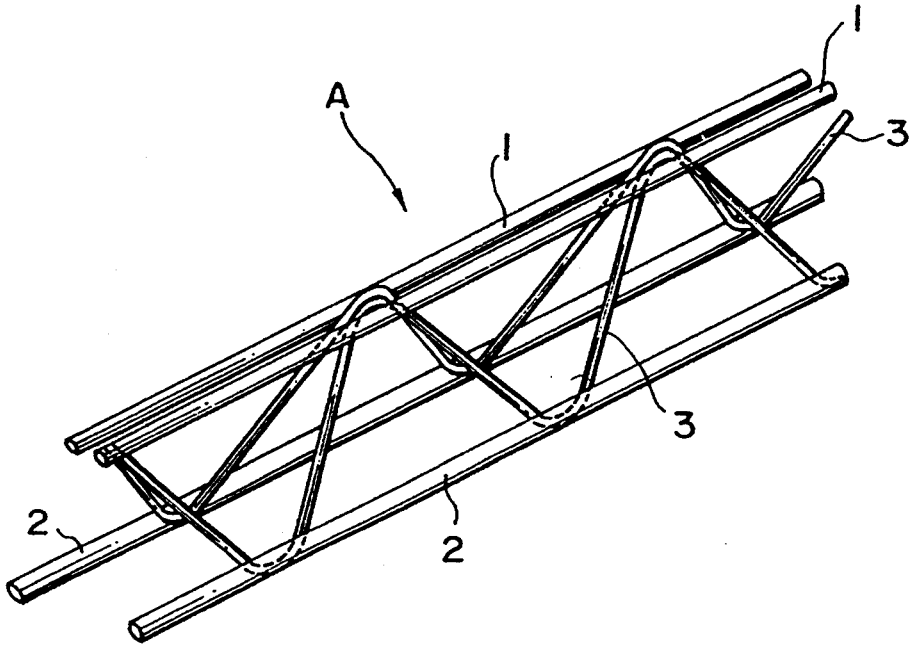
FIG. 1 is a perspective view of a first embodiment of the space truss of the present invention.

As shown in FIG. 1, a first embodiment of a space truss "A" of the present invention is assembled from a pair of plane trusses "a" each of which is constructed of an upper chord member 1, a lower chord member 2 and a strut member 3 through which the upper chord member 1 is fixedly connected with the lower chord member 2.

Figure 2A:
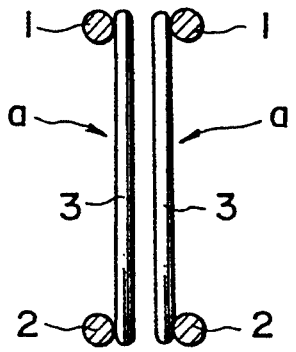
FIG. 2A is a cross-sectional of the plane trusses oppositely disposed from each other, from which plane trusses the space truss of the present invention is assembled in a manner shown in FIG. 2B is a cross-sectional view of the plane trusses of FIG. 2A in a final configuration.
Figure 2B:
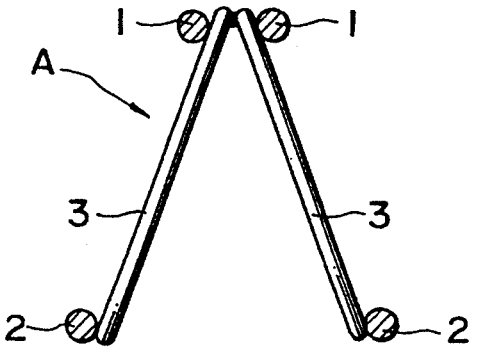

The plane trusses "a" are oppositely disposed from each other as shown in FIG. 1. The strut member 3 is a barlike member and has been bent to assume a wave-like form. In assembling of the space truss "A" of the present invention, first of all, as shown in FIG. 2A, the plane trusses "a" are oppositely disposed from each other, so that a pair of the strut members 3, each of which fixedly connects the upper chord member 1 to the lower chord member 2 by welding, wiring or like fastening measures, are interposed between the plane trusses "a". After that, as shown in FIG. 2B, upper portions of the thus arranged strut members 3 of the plane trusses "a" are fixedly connected with each other by welding, wiring or like fastening measures in a condition in which the lower chord members 2 of the plane trusses "a" are spaced apart from each other, so that the space truss "A" of the present invention shown in FIG. 1 is assembled.

Figure 3:
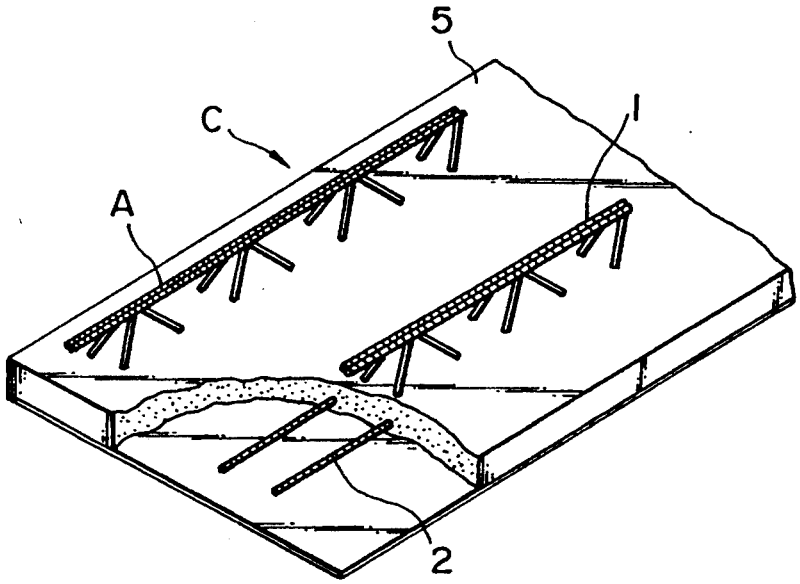
FIG. 3 is a partially broken perspective view of the precast reinforced concrete slab reinforced by the space truss of the present invention shown in FIG. 1.

As shown in FIG. 3, the thus assembled space truss "A" of the present invention is partially embedded in a concrete slab to form a precast reinforced concrete slab "C" reinforced by the space truss "A" of the present invention. As is clear from FIG. 3, in the precast reinforced concrete slab "C", a plurality of the space trusses "A" are so arranged as to be parallel to each other; the lower chord members 2 of the space trusses "A" are completely embedded in the concrete slab "C"; and the upper chord members 1 of the space trusses "A" extend from an upper surface of the concrete slab "C"; whereby the space trusses "A" are integrated into a concrete 5 to form the precast reinforced concrete slab "C".

Figure 4:
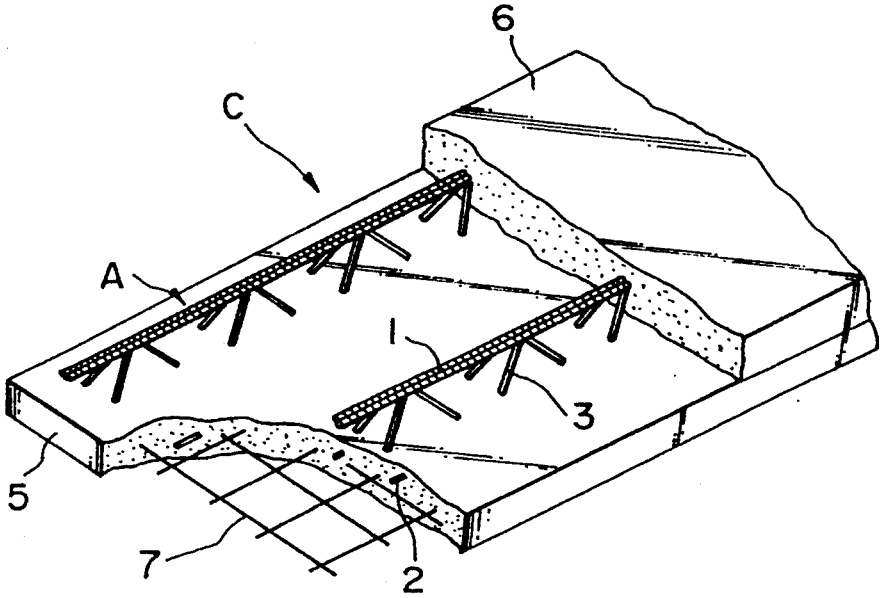
FIG. 4 is a partially broken perspective view of the precast concrete slab reinforced by the space truss of the present invention, which is used as a construction floor on which a concrete is deposited.

As shown in FIG. 4, on the precast reinforced concrete slab "C", an additional concrete 6 is deposited in the construction field to form a reinforced concrete floor. In depositing of the additional concrete 6, both of the upper chord members 1 and the strut members 3 of the space trusses "A" are completely embedded in the additional concrete 6 so that the space trusses "A" of the present invention are completely integrated into the reinforced concrete floor shown in FIG. 4. In addition, as shown in FIG. 4, it is also possible to embed a welded wire-netting 7 in the concrete slab "C" together with the space trusses "A" of the present invention in order to further reinforce the concrete slab "A". Although two pieces of the space trusses "A" are embedded in the concrete slab "C" shown in FIG. 4, the number of the space trusses "A" to be embedded in the concrete slab "C", which is not limited to two, depends on the size of the concrete slab "C".

Figure 5:
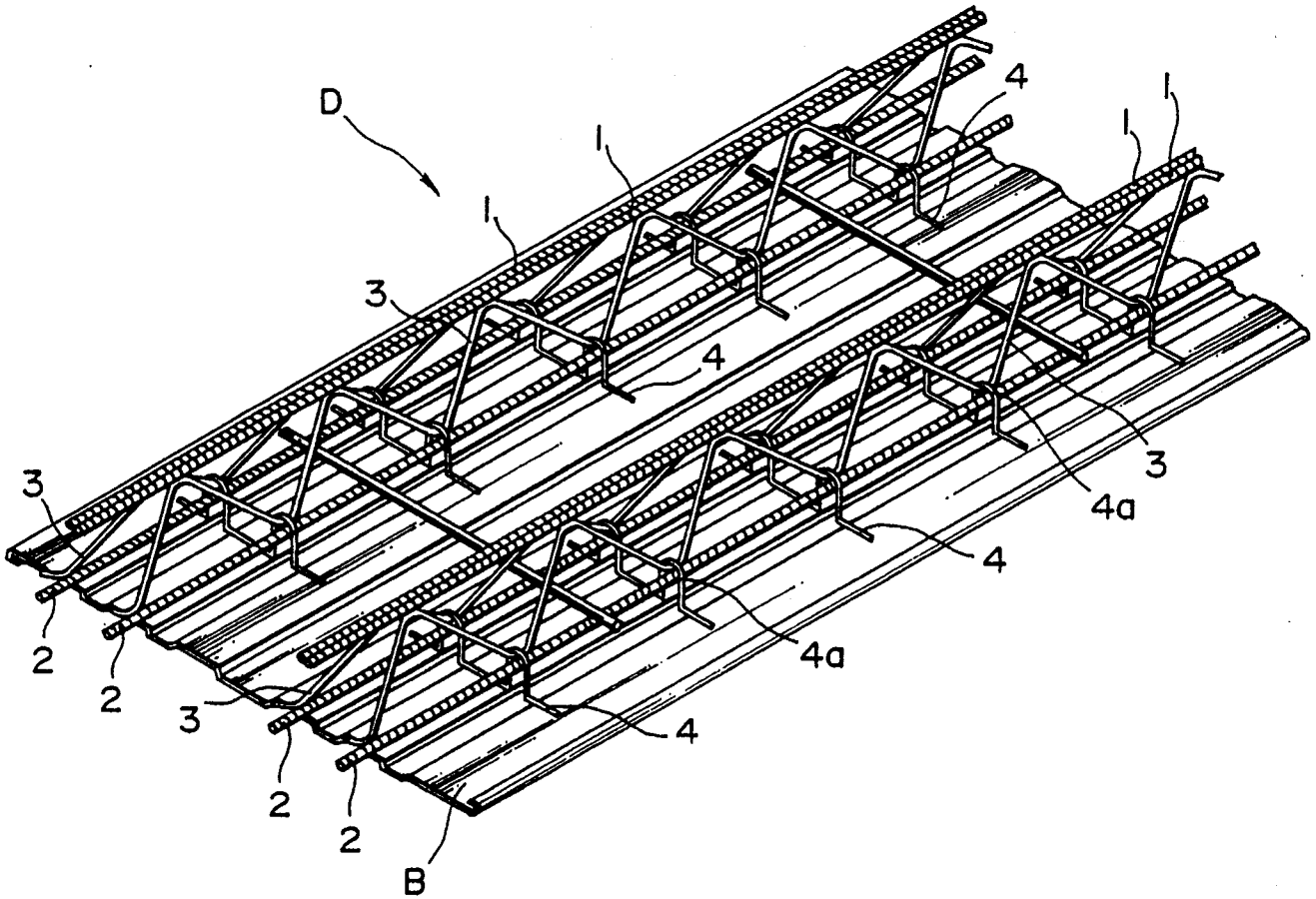
FIG. 5 is a perspective view of a second embodiment of the space truss of the present invention.

FIG. 5 is a perspective view of a second embodiment of the space truss "A" of the present invention, in which embodiment, a plurality of the space trusses "A" of the present invention are so arranged as to be parallel to each other on a sheet steel "B", and a plurality of hanging hooks 4 are so arranged as to be parallel to each other and intersect the space trusses "A" at hook portions 4*a* thereof at right angles, which hook portions 4*a* of the hanging hooks 4 receive the lower chord members 2 and the strut members 3 of the space trusses "A" therein to permit them to vertically move therein to the extent of a predetermined distance, the hanging hooks 4 being fixedly mounted on the sheet steel "B" by welding or like fastening measures, whereby a composite-type space truss "D" is assembled as shown in FIG. 5.

When the concrete 5 is deposited on the compositetype space truss "D" in a factory, the sheet steel "B" is suspended from the space trusses "A" through the hanging hooks 4. Namely, at this time, the hanging hooks 4 engage with the lower chord members 2 and the strut members 3 of the space trusses "A" at their hook portions 4*a* so that the hanging members 4 are suspended from the lower chord members 2 and the strut members 3 at their engaging points. As is clear from FIG. 5, in the composite-type truss "D", the lower chord members 2 and the strut members 3 of the space trusses "A" are loosely received in the hook portions 4*a* of the hanging hooks 4 so as to be able to vertically move to the extent of a predetermined distance relative to the hook portions 4*a* of the hanging hooks 4. In depositing the concrete 5 in the factory, the hook portions 4*a* of the hanging hooks 4 serve as spacers which permits the lower chord members 2 of the space trusses "A" to be sufficiently embedded in or surrounded by the concrete 5.

Figure 6:
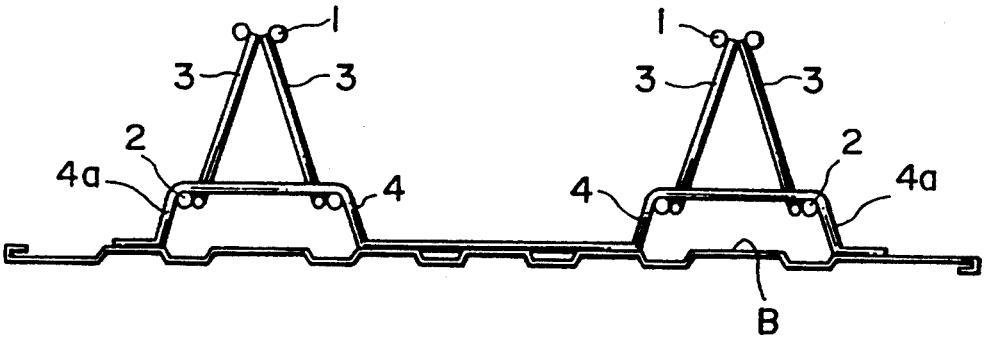
FIG. 6 is a side view of a third embodiment of the space truss of the present invention.

FIG. 6 is a side view of a third embodiment of the space truss "A" of the present invention, which embodiment also assumes a shape of the composite-type space truss "D". As is clear from FIG. 6, in the third embodiment of the present invention, the hanging hook 4 thereof differs in shape from that of the composite-type space truss "D" shown in FIG. 5. Namely, in each of the space trusses "A" of the compositetype space truss "D" shown in FIG. 5, the hanging hook 4 is provided with two hook portions 4*a*. In contrast with this, in each of the space trusses "A" employed in the third embodiment of the present invention shown in FIG. 6, the hanging hook 4 is provided with a single common hook portion 4*b* in which the lower chord member 2 of one of the plane trusses "a" of the space truss "A" is loosely received together with the lower chord member 2 of the other one of the plane trusses "a" of the space truss "A".

Figure 7:
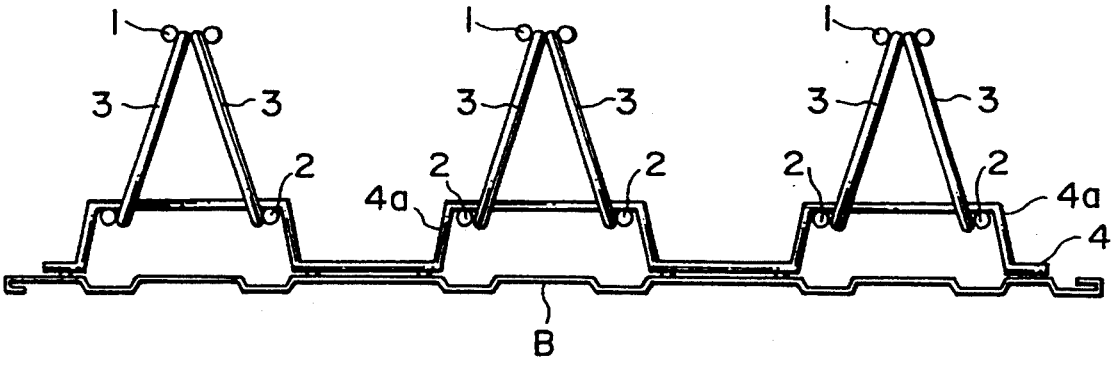
FIG. 7 is a side view of a fourth embodiment of the space truss of the present invention.

In FIG. 7, three space trusses "A" are so arranged as to be parallel to each other on the sheet steel "B", while loosely connected with the hanging hooks 4 which intersect the space trusses "A" at right angles and are fixedly connected with the sheet steel "B" by welding or like fastening measures, whereby further another composite-type space truss "D" is constructed as shown in FIG. 7.

In any of the composite-type space trusses "D" shown in FIG. 5 to 7, the sheet steel "B" is corrugated so as to be improved in rigidity and adhesive properties thereof with respect to the concrete 5 deposited thereon in the factory. When the concrete 5 is deposited on the thus assembled composite-type space trusses "D" shown in FIGS. 5 to 7 in the factory, any of the composite-type space trusses "D" has an extended condition in which the sheet steel "B" is suspended from the space trusses "A".

By depositing the concrete 5 on the composite-type space truss "D" in the factory so as to embed both of the sheet steel "B" and the lower chord members 2 of the composite-type space truss "D" in the concrete 5, the composite-type space truss "D" is integrated with the concrete 5 so as to be formed into the precast reinforced concrete slab "C" serving as concrete floors, concrete walls and like concrete products.

In the construction field, as shown in FIG. 4, the additional concrete 6 is deposited on the thus prepared precast reinforced concrete slab "C" so as to completely embed the extending portions of the composite-type truss "D", i.e., both of the upper chord members 1 and parts of the strut members 3 of the truss "D" in the additional concrete 6.

The space truss "A" of the present invention has the upper chord member 1 fixedly connected with the lower chord member 2 through the strut member 3 to form the plane truss "a"; a pair of the thus prepared plane trusses "a" disposed oppositely from each other; and the strut members 3 of the thus oppositely disposed plane trusses "a" fixedly connected with each other in a condition in which the lower chord members 2 of the plane trusses "a" are spaced apart from each other, so that the space truss "A" of the present invention is constructed. Consequently, the space truss "A" of the present invention having the above construction is quite simple in construction. In addition, in construction, of the space truss "A" of the present invention, since it is very easy for the worker to precisely dispose a pair of the plane trusses "a" oppositely from each other during welding or like fastening processes, the thus constructed space truss "A" of the present invention is excellent in dimensional stability. Furthermore, in the space truss "A" of the present invention, since a pair of the upper chord members 1 are so arranged as to be parallel to each other, the space truss "A" of the present invention is excellent also in structural strength. Consequently, the upper chord members 2 of the space trusses "A" of the present invention extending from the upper surface of the precast reinforced concrete slab "C" are substantially used as a scaffolding when the additional concrete 6 is deposited on the precast concrete slab "C" in the construction field, and, therefore considerably contribute to effective construction of the concrete floors, walls and like concrete members finished in the construction field.

What is claimed is:

1. A space truss comprising a pair of plane trusses oppositely disposed from each other, each of said plane trusses being constructed of a pair of chord members comprising an upper chord member and a lower chord member both of which are fixedly connected to a strut member, said upper chord members of said plane trusses being arranged parallel to each other, spaced apart by said strut members being interposed between said upper chord members of said plane trusses and attached by weldments fixing upper portions of said strut members together, said lower chord members of each of said plane trusses being spaced apart a distance greater than a distance between said upper chord members, a sheet steel, which provides a formwork for receiving poured concrete disposed under said lower chord members of said space truss, a hanging hook welded to said sheet steel interposed between said lower chord members and said sheet steel, and said hanging hook has at least one hook portion through which said hanging hook engages said lower chord members of said space truss to permit said lower chord members of said space truss to move vertically a predetermined distance relative to said hanging hook.

2. The space truss as set forth in claim 1, wherein said sheet steel is a corrugated sheet.

* * * * *